US009534341B2

(12) United States Patent
Esteve

(10) Patent No.: US 9,534,341 B2
(45) Date of Patent: Jan. 3, 2017

(54) IRON FOR IRONING

(75) Inventor: Jérôme Esteve, Stockholm (SE)

(73) Assignee: Aktiebolaget Electrolux (SE)

( * ) Notice: Subject to any disclaimer, the term of this patent is extended or adjusted under 35 U.S.C. 154(b) by 366 days.

(21) Appl. No.: 14/368,391

(22) PCT Filed: Dec. 28, 2011

(86) PCT No.: PCT/EP2011/074122
§ 371 (c)(1),
(2), (4) Date: Aug. 25, 2014

(87) PCT Pub. No.: WO2013/097889
PCT Pub. Date: Jul. 4, 2013

(65) Prior Publication Data
US 2015/0028017 A1 Jan. 29, 2015

(51) Int. Cl.
*D06F 75/26* (2006.01)
*D06F 75/28* (2006.01)
*D06F 75/34* (2006.01)

(52) U.S. Cl.
CPC ..... *D06F 75/26* (2013.01); *D06F 75/28* (2013.01); *D06F 75/34* (2013.01)

(58) Field of Classification Search
None
See application file for complete search history.

(56) References Cited

U.S. PATENT DOCUMENTS 1,681,132 A * 8/1928 Reynolds ..... D06F 79/023 219/246
2,602,248 A * 7/1952 Finlayson ..... D06F 75/26 116/309
2,602,873 A * 7/1952 Finlayson ..... D06F 75/26 219/248
4,357,519 A 11/1982 Bain, Jr.

FOREIGN PATENT DOCUMENTS

CN 2305422 1/1999
CN 1804194 7/2006
GB 583 616 12/1946
GB 607645 A * 9/1948 ..... D06F 75/28
GB 711 504 7/1954

OTHER PUBLICATIONS

Chinese Office Action dated Nov. 26, 2015 for Chinese Application No. 201180076072.9.
International Search Report for International Application No. PCT/EP2011/074122 dated Sep. 19, 2012.

* cited by examiner

*Primary Examiner* — Joseph M Pelham
(74) *Attorney, Agent, or Firm* — RatnerPrestia

(57) ABSTRACT

An iron having a housing, an electrically heated gliding surface, a power cord having a first end passing through an opening in the housing, a sleeve surrounding a portion of the power cord at the first end, and an indicator including a light source. The sleeve is at least partially transparent and the light source is arranged in connection with the sleeve to transmit light through the sleeve.

19 Claims, 6 Drawing Sheets

IRON FOR IRONING

This application is a National Stage Application of International Application No. PCT/EP2011/074122, filed Dec. 28, 2011, the entire disclosure of which is expressly incorporated by reference herein.

TECHNICAL FIELD

The present invention relates to an iron for ironing.

BACKGROUND

An iron may be used for ironing e.g. clothes, textiles, and fabric. The iron comprises a housing with a handle and an electrically heated gliding surface. The iron is commonly used in conjunction with an ironing-board, on which an object to be ironed is placed.

An iron comprises a thermostat which may be set such that the gliding surface is heated to a desired temperature. The iron may comprise an indicator comprising a light source. The indicator may indicate a state of the iron by means of the indicator, e.g. the light source may be switched on during heating of the gliding surface and switched off when the gliding surface has reached a set temperature. The housing is provided with an opening for the light source. The light source is placed in the opening during manufacturing of the iron. It may be problematic to locate the opening in the housing for the light source in order to both ensure that the emitted light from light source is visible to a user of the iron of but not disturbing other functions, for example the thermostat, of the iron.

The iron is connected to an electric wall socket via a power cord. The power cord extends from the iron and may cause irritation to a user of the iron. During ironing, the power cord may hinder movement of the iron over the object to be ironed and the hand and/or arm of a user may be hindered by the power cord. Furthermore, during storing of the iron, the power cord may form an unruly object, which may be entangled with other objects.

U.S. Pat. No. 4,357,519 discloses a power supply cord connection to an electrically heated flatiron having a permanently connected power supply cord extending vertically from the rear of the flatiron handle. The connection permits the cord to frictionally swivel or pivot from front to back along the longitudinal axis of the handle in an elongated slot in the handle between a forward non-interference position when the flatiron is in a multi-point heel rest position and a rearward position preventing cord interference with the work during use of the flatiron. The cord includes a bushing enclosing the cord conductors and an integrally formed enlarged head within the handle straddling the slot and locking the bushing therein.

EP 2048279 discloses an iron having a body connected to a power supply cord and including a cord guiding device that provides a preferred orientation of the cord. The device is pivotably attached to the body and is pivotable between a storage position in which the device is arranged against the body, and an ironing position in which the device is pivoted away from the iron.

SUMMARY

An object is to provide an iron comprising an indicator, wherein the indicator is provided in the iron in an efficient manner.

According to an aspect, the object is achieved by an iron for ironing comprising: a housing, an electrically heated gliding surface connected to the housing, a power cord comprising a first end passing through an opening in the housing and a second end being provided with a plug for connecting the iron to an electric wall socket, a sleeve surrounding a portion of the power cord at the first end, and an indicator comprising a light source. The sleeve is at least partially transparent and the light source is arranged in connection with the sleeve to transmit light through the sleeve.

Since the sleeve is at least partially transparent and light emitted from the light source is transmitted through the sleeve, there is no requirement for the housing of the iron to be provided with a separate arrangement, such as a hole and a sight glass, for the light source. As a result, the above mentioned object is achieved. Furthermore, since the sleeve is commonly arranged at a side of the iron opposite to the gliding surface, the light will be readily visible to a user of the iron from a viewing position above the iron.

The housing of the iron may comprise a handle. The iron may comprise an electrically heated heating element in thermal communication the gliding surface. The iron may be provided with a thermostat which may be set such that the gliding surface is heated to a desired temperature. The indicator may indicate a state of the iron. The light source may emit light of one or more different colours to indicate various states of the iron. The light source may be switched on, or switched off, or may be flashing to indicate various states of the iron. The expression "transmit light through the sleeve" may alternatively be expressed as "light diffuses via the sleeve to an ambient environment of the sleeve". The entire sleeve may be transparent. The sleeve may be transparent to the extent that light from the light source diffuses via the sleeve to an ambient environment of the sleeve and the iron.

According to embodiments, the sleeve may be transparent at least in a circular portion around the power cord. In this manner light from the light source may be transmitted from the sleeve around the entire power cord. When the sleeve is arranged at a side of the iron opposite to the gliding surface, the light is visible from all viewing directions from above the iron, i.e. from all relevant viewing angles which a user may have of the iron during ironing. Information provided by the indicator may thus be easily observed by a user of the iron.

According to embodiments, the light source may be arranged inside the housing. The light source may thus emit light from inside the housing. The light source being arranged inside the housing encompasses the light source being arranged inside the housing to transmit light through the sleeve and being arranged separate from the sleeve.

According to embodiments, the light source may be arranged inside the sleeve. In this manner the light source may be arranged together with the sleeve in the housing during manufacturing. The light source may be arranged in the sleeve inside or outside the housing.

According to embodiments, the sleeve may be flexible. In this manner handling the power cord will be subjected to a gradual change in flexibility. At a free portion of the power cord the power cord has more flexibility than in a portion where the flexibility of the sleeve and the power cord are combined, i.e. along the sleeve.

According to embodiments, the sleeve may extend through the opening. In this manner the power cord is protected by the sleeve as it extends through the opening.

According to embodiments, the opening may be elongated and the sleeve may be arranged to be placed in at least a first position or a second position in the opening. In this manner the power cord may be placed in one suitable position during ironing and in a different suitable position during e.g. storing of the iron. Furthermore, since the sleeve is at least partially transparent and the light source is arranged in connection with the sleeve to transmit light through the sleeve, it is ensured that the transmitted light is visible to a user irrespective of whether the sleeve is placed in the first or the second position.

According to embodiments, the sleeve may have a first diameter having a first length in a portion abutting against a rim of the opening. The opening may have a width of approximately the first length in a second direction and a width of at least 1.5 times the first length in a third direction. In this manner the power cord may be displaced at least half the first length in the opening.

According to embodiments, the opening may comprise at least one narrow portion, and wherein adjacent portions of the opening on both sides of the narrow portion are wider than the narrow portion. In this manner, by means of the narrow portion, the sleeve may be held in a first position on one side of the narrow portion, or in a second position on a second side of the narrow portion.

According to embodiments, the sleeve may be pivotably attached to the housing. In this manner the power cord may be pivoted between at least two positions.

According to embodiments, the housing may comprise a rim around the opening and the sleeve may comprise a ball portion. The ball portion may abut against the rim from an inside of the housing.

According to embodiments, the housing may comprise a handle extending generally along a first direction. The iron may comprise a first elastic sheet connected to the handle along a first edge of the first elastic sheet. The first elastic sheet may be arranged to be wrapped at least partially around the handle substantially perpendicularly to the first direction and releasably connected to the handle along a connecting portion of the first elastic sheet. In this manner the first elastic sheet may be utilized for different functions, such as holding the power cord or forming a gripping portion of the handle. The first elastic sheet may be directly or indirectly releasably connected to the handle along the connecting portion. The first elastic sheet may be permanently connected to the handle along a first edge of the first elastic sheet.

According to embodiments, the iron may comprise a second elastic sheet connected to the handle along a first edge of the second elastic sheet. The second elastic sheet may be arranged to be wrapped at least partially around the handle substantially perpendicularly to the first direction. In this manner the second elastic sheet may be utilized for different functions, such as holding the power cord or forming a gripping portion of the handle. The second elastic sheet may be directly or indirectly releasably connected to the handle along the connecting portion. The second elastic sheet may be permanently connected to the handle along a first edge of the second elastic sheet.

According to embodiments, the first elastic sheet and the second elastic sheet may be releasably connected to each other. In this manner the first and second elastic sheets may be wrapped around the handle to, e.g. to hold the power cord or to the handle or to form a gripping portion of the handle.

According to embodiments, the first elastic sheet and/or the second elastic sheet in a first wrapped position is/are adapted to hold the power cord in a folded state against the handle.

According to embodiments, the first elastic sheet and/or the second elastic sheet in a second wrapped position is/are adapted to form an elastic handle griping portion.

A further object is to provide an iron with improved handling characteristics.

According to an aspect the object is achieved by an iron for ironing comprising: a housing, an electrically heated gliding surface connected to the housing, a power cord comprising a first end passing through an opening in the housing and a second end being provided with a plug for connecting the iron to an electric wall socket. The housing comprises a handle extending generally along a first direction. The iron comprises a first elastic sheet connected to the handle along a first edge of the first elastic sheet. The first elastic sheet is arranged to be wrapped at least partially around the handle substantially perpendicularly to the first direction and to be releasably connected to the handle along a connecting portion of the first elastic sheet.

Since the first elastic sheet is releasably connected to the handle, it may be utilized for different functions, such as holding the power cord or forming an elastic handle gripping portion of the handle. As a result, the object is achieved.

Aspects and embodiments mentioned above may be applicable to the iron comprising the first elastic sheet. In particular, it is repeated that the first elastic sheet may be directly or indirectly releasably connected to the handle along the connecting portion and that the iron may comprise a second elastic sheet.

A sleeve may surround a portion of the power cord at the first end. The iron may comprise an indicator comprising a light source. The sleeve may be at least partially transparent and the light source may be arranged in connection with the sleeve to transmit light through the sleeve. The first elastic sheet may be directly connected to the handle along the first edge.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Like numbers refer to like elements throughout.

Well-known functions or constructions will not necessarily be described in detail for brevity and/or clarity.

Figure 1:
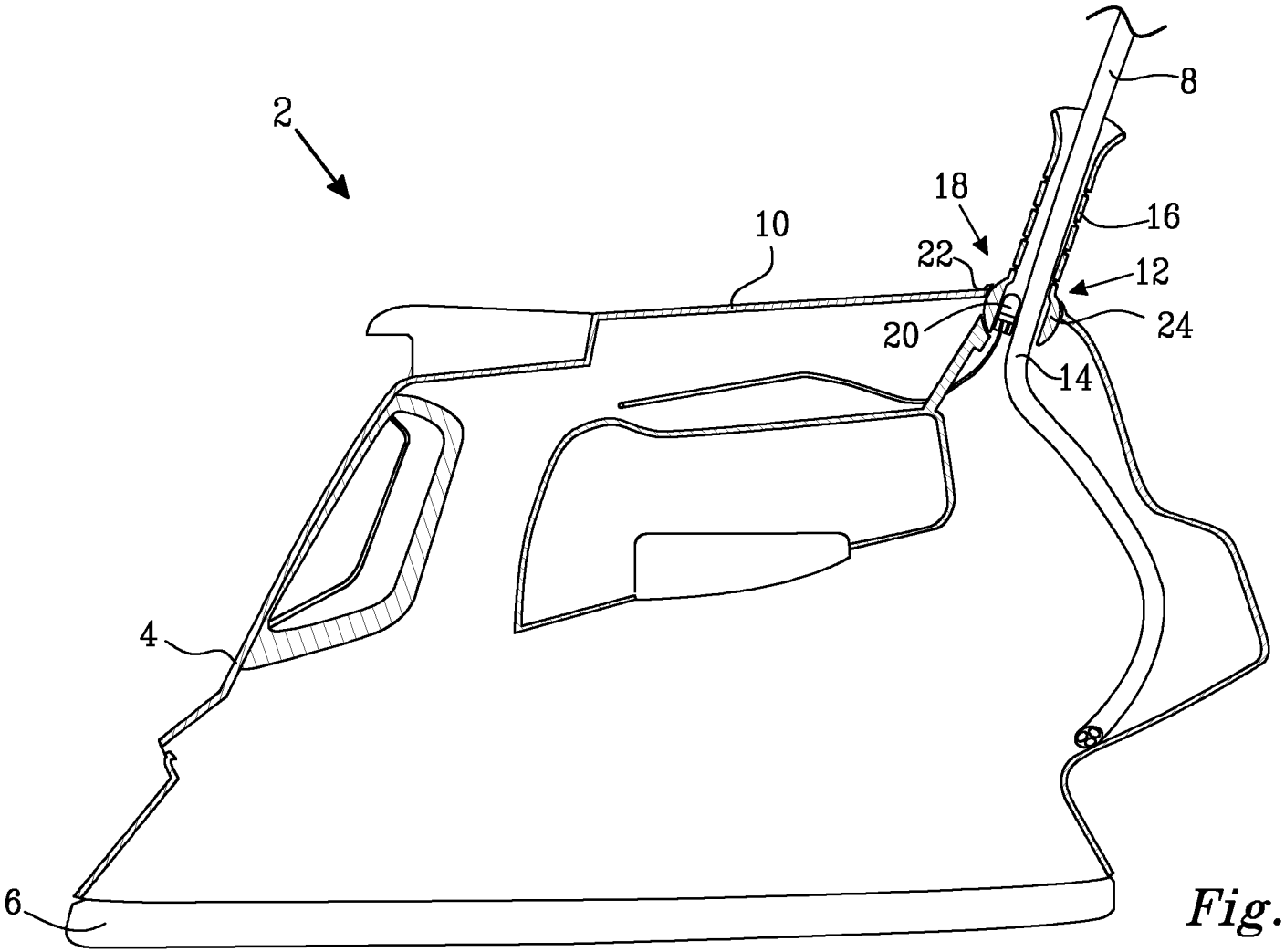
FIG. 1 illustrates schematically a cross section through an iron according to embodiments, and FIGS. 2, 3, and 4 *a-c* illustrate irons according to embodiments.

FIG. 1 illustrates schematically a cross section through an iron 2 according to embodiments. The iron 2 comprises a housing 4, a heated gliding surface 6 connected to the housing 4, and a power cord 8. The housing 4 comprises a handle 10 and is provided with an opening 12, through which a first end 14 of the power cord 8 passes from an outside of the housing 4 into the housing 4. A second end of the power cord (not shown in FIG. 1) is provided with a plug for connecting the iron 2 to an electric wall socket. A sleeve 16 surrounds a portion of the power cord 8 at the first end 14. The sleeve 16 extends through the opening 12 and is at least partially transparent and flexible. Accordingly, the sleeve 16 may be made from a transparent plastic material, e.g. a material comprising polypropylene. Thanks to the flexibility of the sleeve 16, the power cord 8 will not be subjected to a sharp bend over an edge of the opening 12. Instead, the power cord 8 will be subjected to gradual change in flexibility from a free portion of the power cord via the sleeve 16 into the housing 4.

The iron 2 comprises further parts, which have been omitted in FIG. 1 for the sake of clarity, such as an electric heating element arranged in thermal communication with the gliding surface 6, a thermostat for setting a desired ironing temperature of the gliding surface 6. The iron 2 may comprise further elements such as e.g. a water container to be filled with water for producing steam and a water spraying arrangement for spraying water from the water container onto objects to be ironed.

The iron 2 comprises an indicator 18 comprising a light source 20, which is arranged in the sleeve 16. The light source 20 is illustrated comprising an LED, but may alternatively comprise e.g. a light bulb. The light source 20 is connected to a non-shown control circuit well known in the art. The light source 20 may be adapted to produce light within a limited wavelength span, i.e. coloured light, or light with a broad wavelength span, i.e. white light. The light source 20 may be adapted to emit light of different colours at a time. Since the sleeve 16 is at least partially transparent, the light source 20 is arranged to transmit light through the sleeve 16. Thus, light diffuses via the sleeve 16 to an ambient environment of the sleeve 16 and the iron 2.

The light source 20 may be arranged in alternative positions in the housing 4 as long as the light source 20 is arranged in connection with the sleeve 16. Thus, the light source will transmit light through opening 12 and the sleeve 16 from an inside of the housing 4 to an outside of the housing 4.

The housing 4 comprises a rim 22 around the opening 12. The sleeve 16 comprises a ball portion 24. The ball portion 24 abuts against the rim 22 from an inside of the housing 4. The sleeve 16 is pivotably attached to the housing 4 by means of the ball portion 24, which is in pivotable abutment with the rim 22. Thus, the power cord 8 may be pivoted into suitable positions during ironing and during storing of the iron 2.

Figure 2:
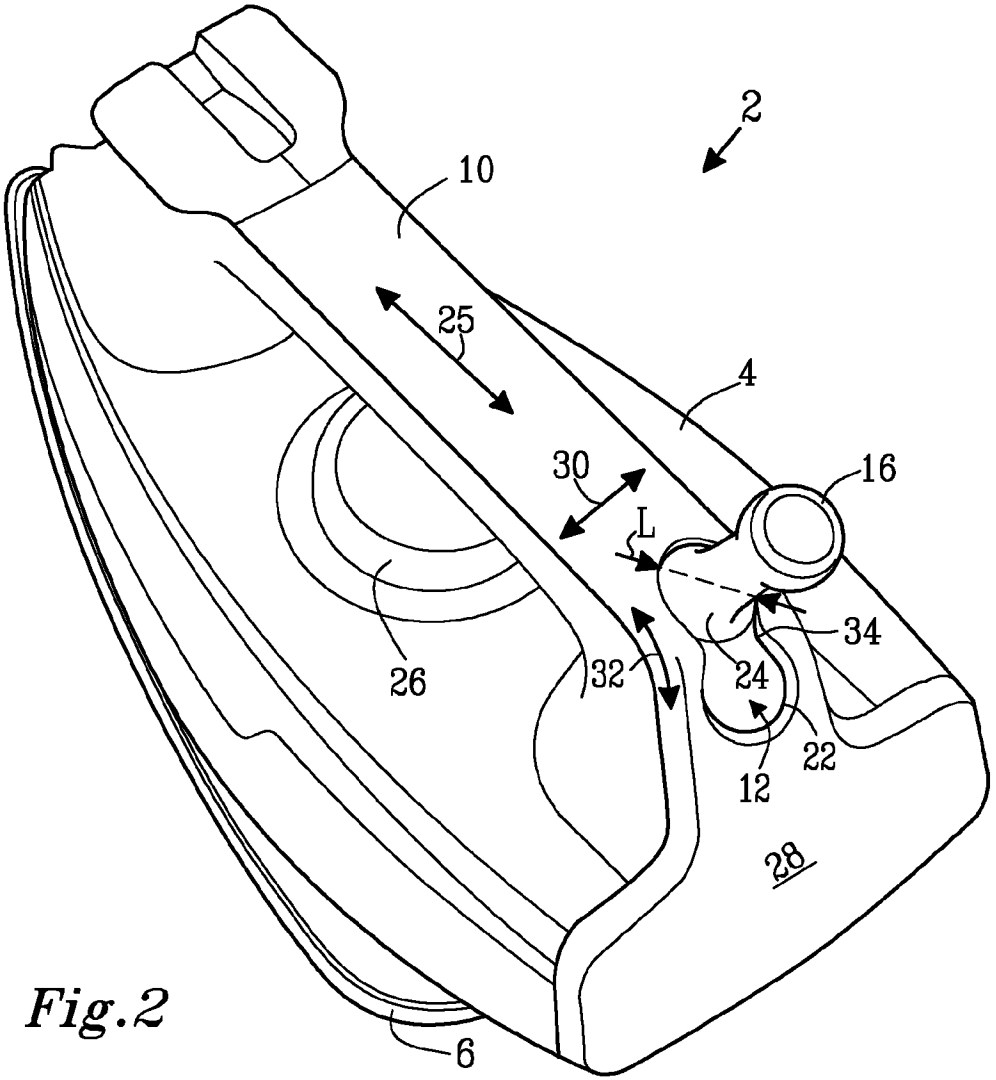

FIG. 2 illustrates an iron 2 according to embodiments. The iron 2 comprises a housing 4 and a heated gliding surface 6 connected to the housing 4. The housing 4 comprises a handle 10 extending along a first direction 25. A user grasping the handle 10 with a hand grasps substantially perpendicularly to the first direction 25 about the handle 10 with the first direction 25 extending along the grip of the hand. A knob 26 of a thermostat is arranged on the housing beneath the handle 10. By means of the thermostat a desired temperature of gliding surface 6 of the iron 2 may be set.

The housing 4 is provided with an opening 12. Through the opening 12 a flexible sleeve 16 extends. A power cord (not-shown) is arranged to extend through the sleeve 16. Thus, the sleeve 16 protects the power cord as it extends into the housing 4 through the opening 12. The sleeve 16 may be at least partially transparent. A light source of an indicator may be arranged to transmit light through the sleeve 16, i.e. to diffuse light via the sleeve 16 to an ambient environment.

The opening 12 is elongated and is arranged at one end of the handle 6. Seen with the iron 2 standing on its gliding surface 6, the opening 12 extends from an upper side of the handle 10 to a first side surface 28 of the iron 2. The first side surface 28 is arranged at a short end of the handle 10 substantially perpendicularly to the first direction 25. The sleeve 16 may be placed in a first position or a second position in the opening 12. Seen with the iron 2 is standing on its gliding surface 6, the sleeve 16 is arranged in an upwardly direction in the first position, as illustrated in FIG. 2. The first position of the sleeve 16 may be suitable for storing of the iron 2, or when the iron 2 is standing on the first side surface 28 as is common during ironing when the gliding surface 6 is warm and a user repositions an object to be ironed. Seen with the iron 2 standing on its gliding surface, the sleeve 16 is arranged pointing out from the first side surface 28 in the second position. The second position of the sleeve 16 may be suitable during ironing when a user is holding the iron 2 by the handle 10 and moving the iron 2 back and forth over the object to be ironed. Light emitted from the light source and diffused via the sleeve 16 is visible to a user irrespective of whether the sleeve 16 is placed in the first position or the second position.

The housing 4 comprises a rim 22 around the opening 12. The sleeve 16 comprises a ball portion 24 arranged inside the housing 4. The ball portion 24 abuts against the rim 22 from an inside of the housing 4.

The sleeve 16 has a first diameter having a first length L in a portion abutting against the rim 22. That is, in these embodiments a portion of the ball portion 24 abutting against the rim 22 has the first diameter with the first length L. The opening 12 has a width of approximately the first length L in a second direction 30 and a width of at least 1.5 times the first length L in a third direction 32. The opening 12 comprises at least one narrow portion 34. Adjacent portions of the opening 12 on both sides of the narrow portion 34 are wider than the narrow portion 34. Due to the narrow portion 34, the first position and the second position of the sleeve 16 in the opening 12 are defined on each side of the narrow portion 34.

The ball portion 24 of the sleeve 16 is held in place inside the housing 4 by one or more ridges, by one or more concave socket portions, or by similar means. The sleeve 16 is thus held in place in both the first and second positions. The sleeve 16 is pivotably attached to the housing 4 due to the provision of the first and second possible positions, in each of which the sleeve 16 points in a different direction. Moreover, the sleeve 16 may be pivotable in each of the first and second positions.

Figure 3:
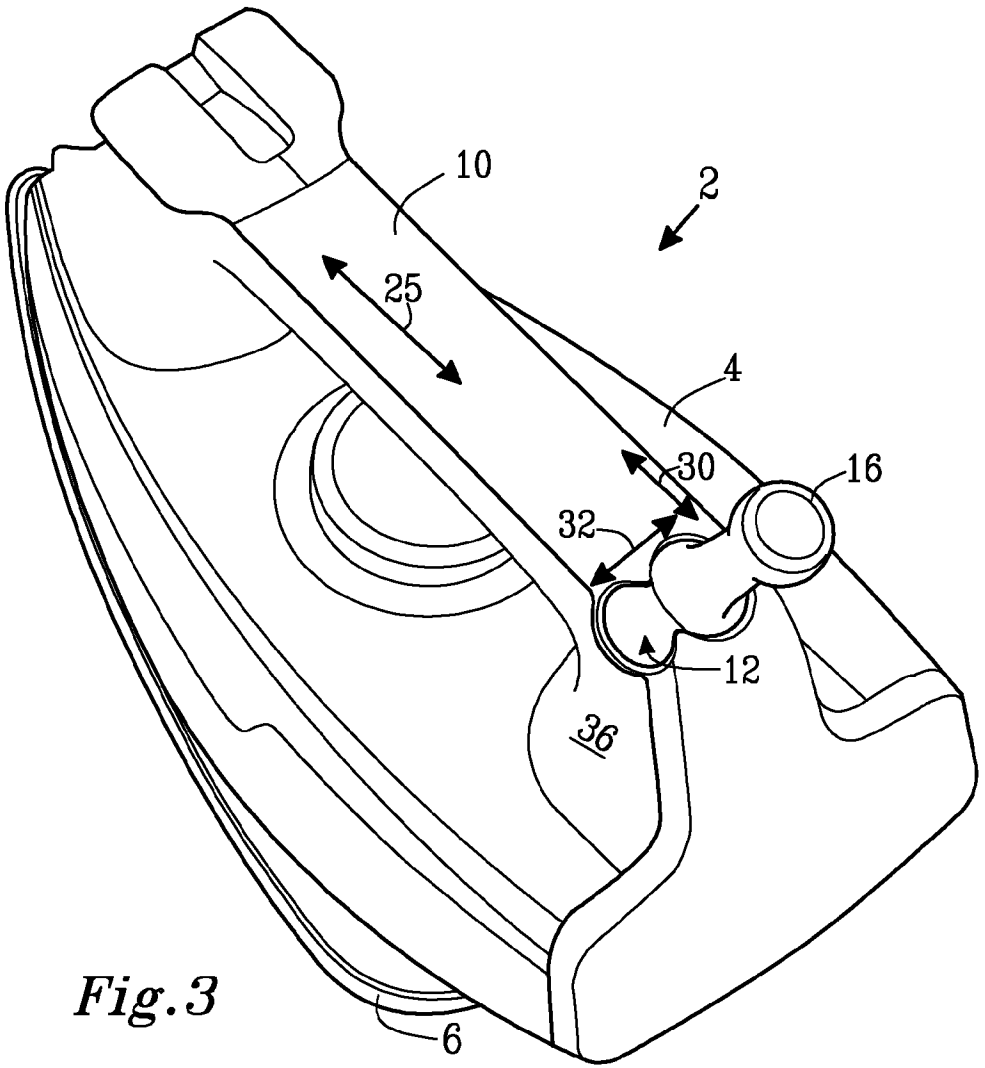

FIG. 3 illustrates an iron 2 according to embodiments. The iron 2 comprises a housing 4 and a heated gliding surface 6 connected to the housing 4. The housing 4 comprises a handle 10 extending along a first direction 25. These embodiments have several features in common with the embodiments of FIG. 2. In the following the main differences of the FIG. 3 and FIG. 2 embodiments are discussed.

The housing 4 is provided with an elongated opening 12 at one end of the handle 10. Seen with the iron 2 standing on its gliding surface 6, the opening 12 extends from an upper side of the handle 10 to a second side surface 36 of the iron 2. The second side surface 36 forms part of a lateral side surface of the handle 6 and extends at least partially in parallel with the first direction 25. Accordingly, in these embodiments the second direction 30 extends substantially in parallel with the first direction 25 and the third direction 32 extends substantially perpendicularly to the first direction 25.

A sleeve 16 extending through the opening 12 may be placed in a first position or a second position in the opening 12. Seen with the iron 2 standing on its gliding surface 6, the sleeve 16 is arranged in an upwardly direction in the first position, as illustrated in FIG. 3. Seen with the iron 2 standing on its gliding surface, the sleeve 16 is arranged pointing out from the second side surface 36 in the second position.

Figure 4A:
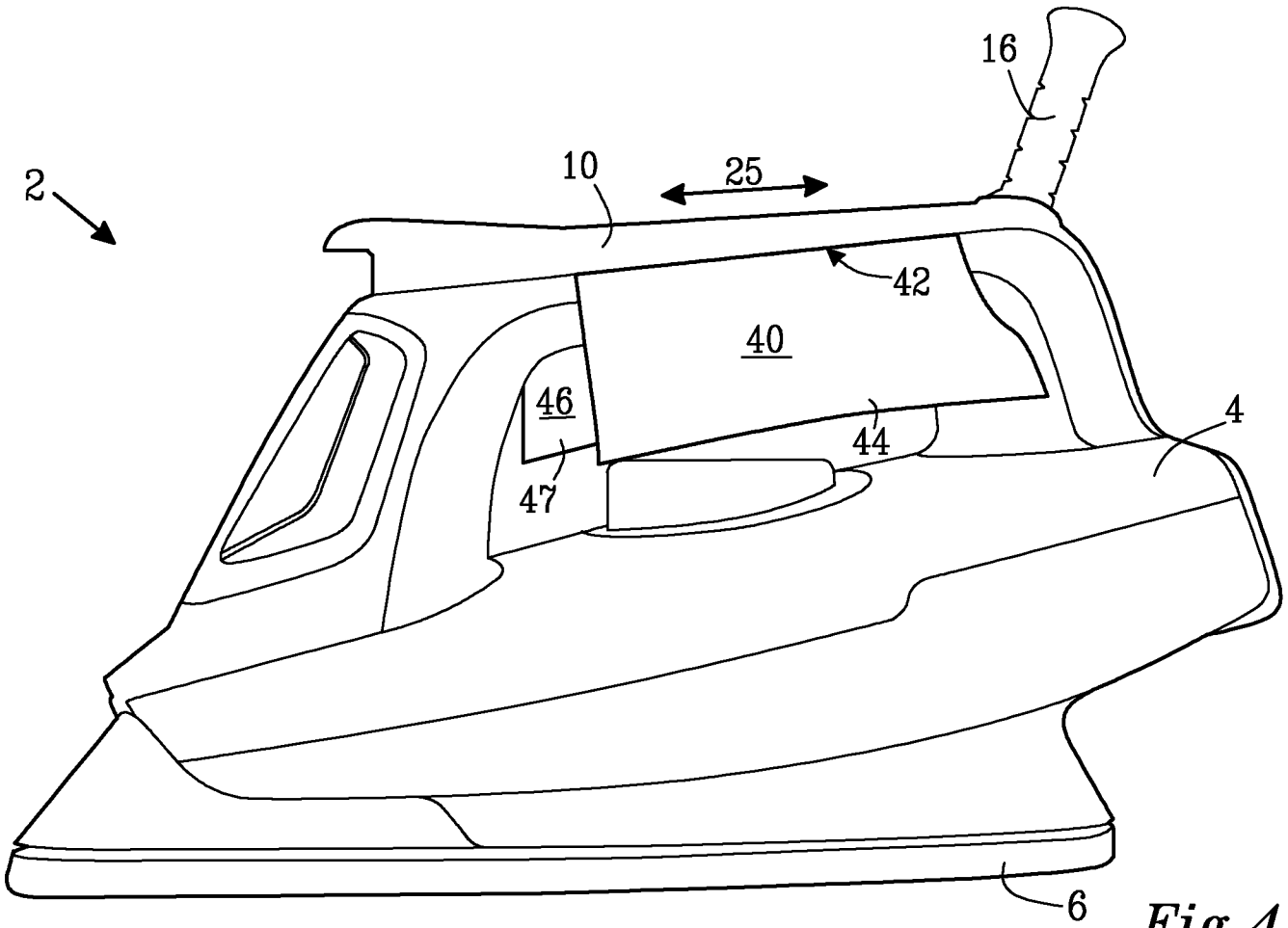
Figure 4B:
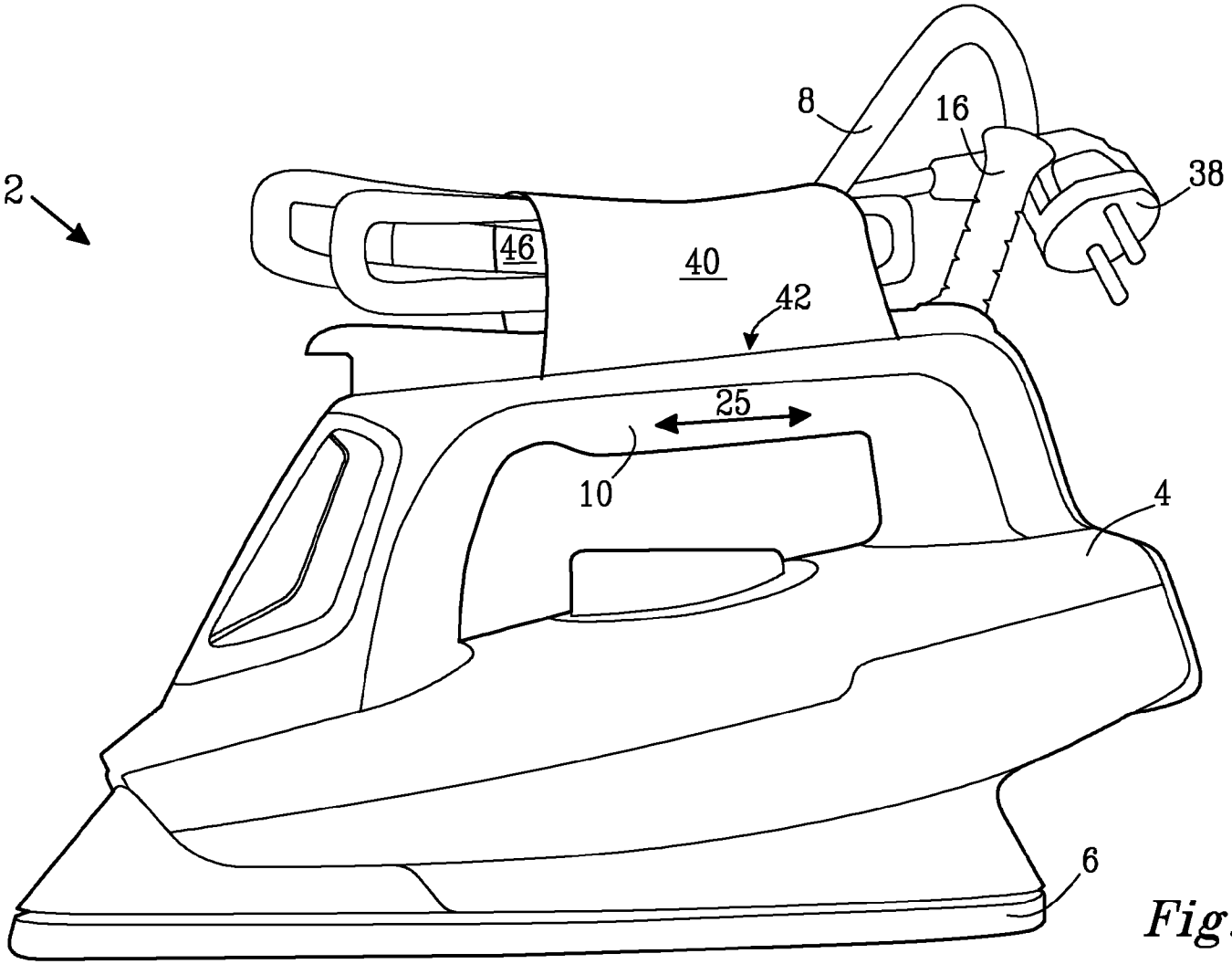
Figure 4C:
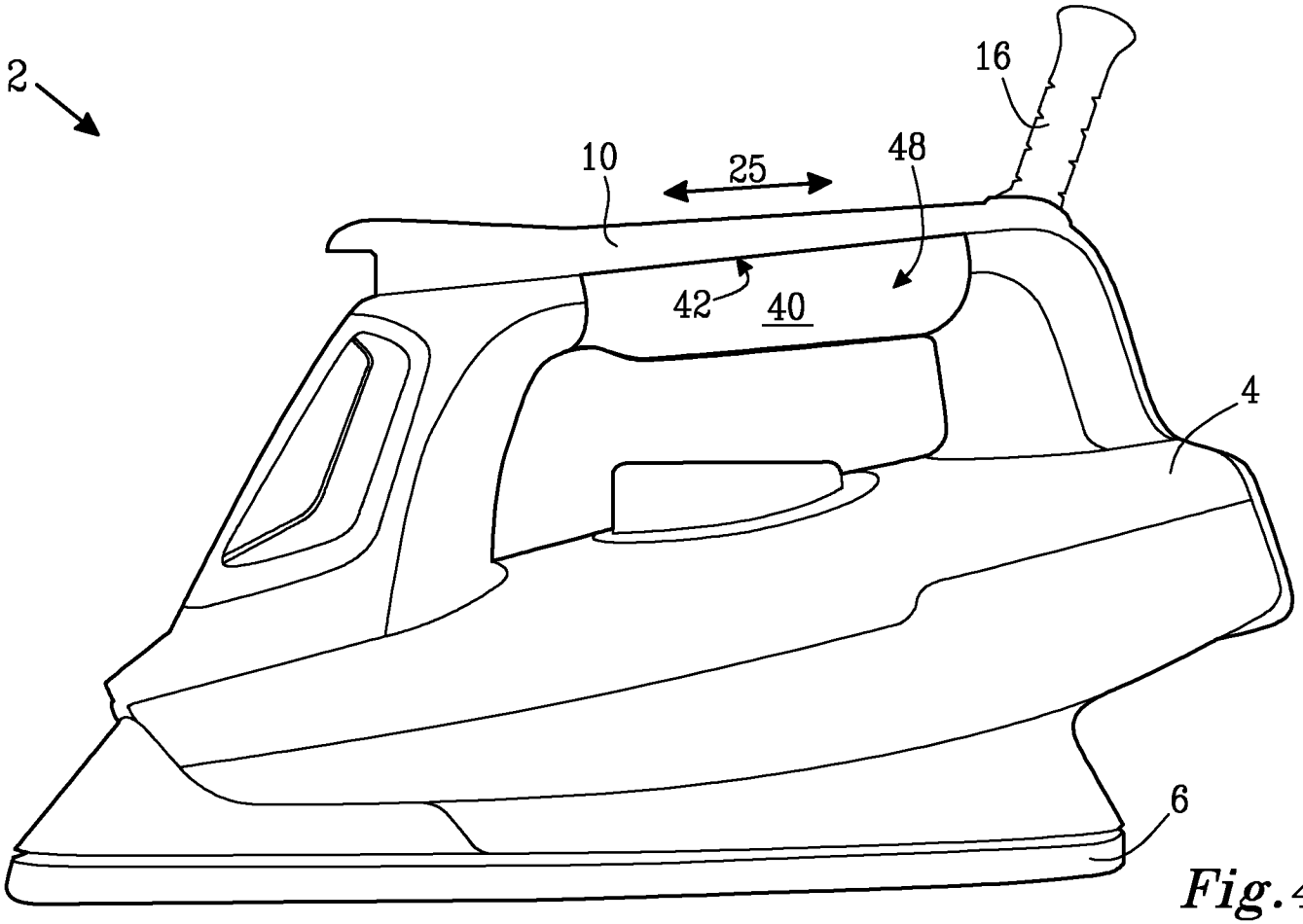

FIGS. 4 *a-c* illustrate an iron 2 according to embodiments. The iron 2 comprises a housing 4 and an electrically heated gliding surface 6 connected to the housing 4. The housing 4 comprises a handle 10. The housing 4 is provided with an opening, through which a first end of a power cord 8 (omitted in FIGS. 4*a* and 4*c*) passes. A second end of the power cord 8 is provided with a plug 38 for connecting the iron 2 to an electric wall socket. A sleeve 16 surrounds a portion of the power cord 8. The sleeve 16 may extend through the opening in the housing 4 and may be at least partially transparent and flexible.

The handle 10 extends generally along a first direction 25. The iron 2 comprises a first elastic sheet 40 connected to the handle 10 along a first edge 42 of the first elastic sheet 40. The first elastic sheet 40 is arranged to be wrapped at least partially around the handle 10 substantially perpendicularly to the first direction 25 and releasably connected to the handle 10 along a connecting portion 44 of the first elastic sheet 40.

The iron 2 comprises a second elastic sheet 46 connected to the handle 10 along a first edge of the second elastic sheet 46. The second elastic sheet 48 is arranged to be wrapped at least partially around the handle 10 substantially perpendicularly to the first direction 25 and releasably connected to the handle 10 along a connecting portion 47 of the first elastic sheet 40.

The first elastic sheet 40 and the second elastic sheet 46 may be formed from e.g. neoprene rubber and may be utilized for different functions. The elastic sheets 40, 46 may hold the power cord 8 in a folded state against the handle 10 during storing of the iron 2, as illustrated in FIG. 4*b*. The first and/or the second elastic sheets 40, 46 may form an elastic handle griping portion 48 of the handle 10, as illustrated in FIG. 4*c*. The elastic handle gripping portion 48 may be agreeable for a user to hold during ironing. FIG. 4*b* illustrate the first elastic sheet 40 and/or the second elastic sheet 46 in a first wrapped position adapted to hold the power cord 8 in the folded state against the handle 10. FIG. 4*c* illustrate the first elastic sheet 40 and/or the second elastic sheet 46 in a second wrapped position adapted to form the elastic handle griping portion 48.

The first and second elastic sheets 40, 46 may be directly or indirectly releasably connected to the handle 10 along their respective connecting portions 44, 47. Such an indirect connection may be formed by means of the other of the first and second elastic sheets 40, 46. Accordingly, the first elastic sheet 40 and the second elastic sheet 46 may be releasably connected to each other. The first elastic sheet 40 may be directly connected to the handle 10 along the first edge 42. Similarly, the second elastic sheet 46 may be directly connected to the along an edge thereof.

The respective connecting portions 44, 47 may extend along a free edge of the respective elastic sheet 40, 46. Alternatively, one or both of the respective connecting portions 44, 47 may extend in parallel with a respective free edge of the relevant elastic sheet 40, 47, at a distance from the respective free edge. The connecting portions 44, 47 may comprise hook and loop fastening means.

In embodiments comprising only the first elastic sheet 40, an example of an indirect connection of the connecting portion 44 to the handle 10 is the connecting portion 44 connecting to the first elastic sheet 40 itself, e.g. by wrapping the first elastic sheet 40 a full turn around the handle 10.

Although the invention has been described with reference to example embodiments, many different alterations, modifications and the like will become apparent for those skilled in the art. For instance, the first elastic sheet may be wrapped around the handle to cover e.g. a lower half of the handle and the second elastic sheet may be wrapped around the handle to cover an upper half of the handle in order to form an elastic handle gripping portion of the handle. The first and second elastic sheets may be formed by one single elastic piece of material, which extends through the handle with a first free end of the single elastic piece of material forming the first elastic sheet on one side of the handle and a second free end on an opposite side of the handle forming the second elastic sheet.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

It will be understood that although the terms first, second, third etc. may be used herein to describe various elements, components, regions, layers and/or sections, these elements, components, regions, layers and/or sections should not be limited by these terms. These terms are only used top distinguish one element, component, region, layer or section from another element, component, region, layer or section. Thus, a first element, component, region, layer or section discussed herein could be termed a second element, component, region, layer or section without departing from the teachings of the present invention.

The invention claimed is:

1. An iron for ironing comprising:

a housing, an electrically heated gliding surface connected to the housing;

a power cord comprising a first end passing through an opening in the housing and a second end being provided with a plug for connecting the iron to an electric wall socket;

a sleeve surrounding a portion of the power cord at the first end; and an indicator comprising a light source;

wherein the sleeve is at least partially transparent, and the light source is arranged in connection with the sleeve to transmit light through the sleeve.

2. The iron according to claim 1, wherein the light source is arranged inside the housing.

3. The iron according to claim 1, wherein the light source is arranged inside the sleeve.

4. The iron according to claim 1, wherein the sleeve is flexible.

5. The iron according to claim 1, wherein the sleeve extends through the opening.

6. The iron according to claim 5, wherein the opening is elongated and the sleeve is movable between at least a first position and a second position in the opening.

7. The iron according to claim 6, wherein a portion of the sleeve adjacent an edge of the opening has a first diameter, and wherein the opening has a first width approximately equal to the first diameter and a length equal to at least 1.5 times the first diameter.

8. The iron according to claim 7, wherein the opening comprises at least one narrow portion having a second width, the second width being less than the first width, and wherein adjacent portions of the opening on both sides of the narrow portion are wider than the narrow portion.

9. The iron according to claim 1, wherein the sleeve is pivotably attached to the housing.

10. The iron according to claim 1, wherein the housing comprises a rim around the opening and the sleeve comprises a ball portion, and wherein the ball portion abuts against the rim from an inside of the housing.

11. The iron according to claim 1, wherein the housing comprises a handle extending generally along a first direction, and wherein the iron comprises a first elastic sheet connected to the handle along a first edge of the first elastic sheet, the first elastic sheet being configurable to a first wrapped position in which the first elastic sheet is wrapped at least partially around the handle substantially perpendicularly to the first direction and releasably connected to the handle along a connecting portion of the first elastic sheet.

12. The iron according to claim 11, wherein the iron comprises a second elastic sheet connected to the handle along a first edge of the second elastic sheet, the second elastic sheet being configurable to a first wrapped position in which the second elastic sheet is wrapped at least partially around the handle substantially perpendicularly to the first direction.

13. The iron according to claim 12, wherein the first elastic sheet and the second elastic sheet are releasably connected to each other.

14. The iron according to claim 11, wherein the first elastic sheet in the first wrapped position is configured to hold the power cord in a folded state against the handle.

15. The iron according to claim 11, wherein the first elastic sheet is configurable to a second wrapped position in which the first elastic sheet forms at least a portion of an elastic handle gripping portion.

16. The iron according to claim 2, wherein the light source is arranged inside the sleeve.

17. The iron according to claim 12, wherein the first elastic sheet and the second elastic sheet are configured to hold the power cord in a folded state against the handle when the first elastic sheet and the second elastic sheet are in their respective first wrapped positions.

18. The iron according to claim 13, wherein the first elastic sheet and the second elastic sheet are adapted to hold the power cord in a folded state against the handle when the first elastic sheet and the second elastic sheet are in their respective first wrapped positions.

19. The iron according to claim 12, wherein the first elastic sheet and the second elastic sheet are configurable to respective second wrapped positions to form an elastic handle gripping portion.

* * * * *